US005927213A

United States Patent [19]

Leday

[11] Patent Number: 5,927,213

[45] Date of Patent: Jul. 27, 1999

[54] TABLE ARRANGEMENT WITH CONTROLLED MOVABLE ELEMENTS, IN PARTICULAR FOR MOBILITY IMPAIRED PERSONS

[75] Inventor: Michel Leday, Talence, France

[73] Assignee: Exess Technologie, Pessac, France

[21] Appl. No.: 08/737,556

[22] PCT Filed: May 9, 1995

[86] PCT No.: PCT/FR95/00602

§ 371 Date: Jan. 13, 1997

§ 102(e) Date: Jan. 13, 1997

[87] PCT Pub. No.: WO95/30356

PCT Pub. Date: Nov. 16, 1995

[30] Foreign Application Priority Data

May 10, 1994 [FR] France ..... 94 06018

[51] Int. Cl.[6] ..... A47B 57/00

[52] U.S. Cl. ..... 108/96; 108/102; 108/106; 108/147

[58] Field of Search ..... 108/20, 93, 96, 108/102, 106, 146, 143

[56] References Cited

U.S. PATENT DOCUMENTS

| | | | |
|---|---|---|---|
| 654,922 | 7/1900 | Schipkowsky | 312/196 |
| 4,226,191 | 10/1980 | Espana | 108/20 |
| 5,088,420 | 2/1992 | Russell | 108/96 |
| 5,259,326 | 11/1993 | Borgman et al. | 108/20 |

*Primary Examiner*—Peter M. Cuomo
*Assistant Examiner*—Gerald A. Anderson
*Attorney, Agent, or Firm*—Young & Thompson

[57] ABSTRACT

Ergonomically, adjustable table with movable elements, in particular, for a mobility impaired person, comprising a frame (10) with a base (12) and at least two vertical members (14) secured thereto, and a stationary plate (16) secured to said vertical members. The table is characterized by having, at the rear, a first plate capable of vertical translation between a low retracted position and a hight work position at right angles to the stationary plate (16) and a second plate (20) capable of horizontal translation, arranged parallel and immediately above the stationary plate. The table is suitable for teaching applications.

9 Claims, 6 Drawing Sheets

TABLE ARRANGEMENT WITH CONTROLLED MOVABLE ELEMENTS, IN PARTICULAR FOR MOBILITY IMPAIRED PERSONS

FIELD OF THE INVENTION

The present invention concerns a table with mobile elements having ergonomic adjustment possibilities and able to be used for handicapped persons.

BACKGROUND OF THE INVENTION

In the sphere of school education and more specifically in teaching establishments for handicapped persons, it is essential to provide these persons with ergonomy so as to obtain satisfactory results.

In fact, the teaching of data processing or certain manual subjects is carried out with known types of equipment which are inadequate, either because they cannot be adjusted in certain directions, or because their dispositions are specific and intangible, for example the controls of movements of certain portions of the table which are not accessible to handicapped persons.

In addition, when these handicapped persons use wheelchairs, the equipment must allow the seat to be placed and be equipped with means for protection against impacts generated by the movements of these wheelchairs.

Furthermore, it is essential that these items of equipment are extremely stable as they are generally relatively close to one another, which increases the risks of turning over.

The main criterion here is to provide a multipurpose capacity.

In fact, the purchase price of these items of equipment is of necessity relatively high considering the degree of sophistication with the result that the percentage of use needs to be sufficient so as to justify its purchase.

The increase of the percentage is quite natural when a given table can be used for various applications.

SUMMARY OF THE INVENTION

The invention also concerns a multi-purpose table including a large number of adjustments ensuring a specific ergonomic adaptation for a handicapped person, is compact, can have its mobile elements controlled when moving and which is extremely safe as regards its operation.

To this effect, the ergonomically adjustable mobile element table of the invention, able to be used by a handicapped person and including a frame with a base and at least two stanchions integral with said base and a fixed plate integral with said stanchions, is characterized in that it includes at the rear one first mobile plate able to move vertically between a bottom retracted position and an upper working position in front of the fixed plate and a second plate able to move horizontally and disposed immediately above and parallel to the fixed plate.

More specifically, the first plate able to move vertically includes an auxiliary plate able to move horizontally with respect to this first plate offset towards the front so as to be superimposed with the fixed plate.

As for the fixed plate, this includes an auxiliary plate able to move horizontally with respect to this fixed plate and is offset towards the front and is of the computer keyboard support type.

According to the preferred embodiment of the invention, the stanchions of the fixed plate include height adjustment means with respect to the frame, said height adjustment means including a first and second jack associated with each stanchion, each stanchion including two telescopic portions between which the corresponding jack is inserted, the first portion being integral with the base of the frame and the second portion supporting the fixed, mobile and auxiliary plates.

According to one variant of the table of the invention, the height adjustment means include a telescopic jack which is single for at least two elements, the lower element being integral with the base of the frame and the upper element supporting the fixed and motile plates.

According to one improvement of the table, the frontal edge of the fixed plate includes a control box able to move laterally.

In the case of the table of the present invention, electric motors are provided to move the mobile plates, as well as end of travel sensors and force sensors so as to avoid jamming and mechanical pressure effects.

The frame also includes a clearance on the front face so as to give access of handicapped persons to wheelchairs.

Similarly, the frame includes a rear stop for protection of the spacing corresponding to the maximum rear spatial requirement of the plates.

Finally, the table includes a programmable robot for controlling the motors and jacks and is connected to the mobile control box.

BRIEF DESCRIPTION OF THE DRAWINGS

The table of the invention is now described as follows with reference to the accompanying drawings which respectively represent.

DETAILED DESCRIPTION OF THE INVENTION

Figure 1:
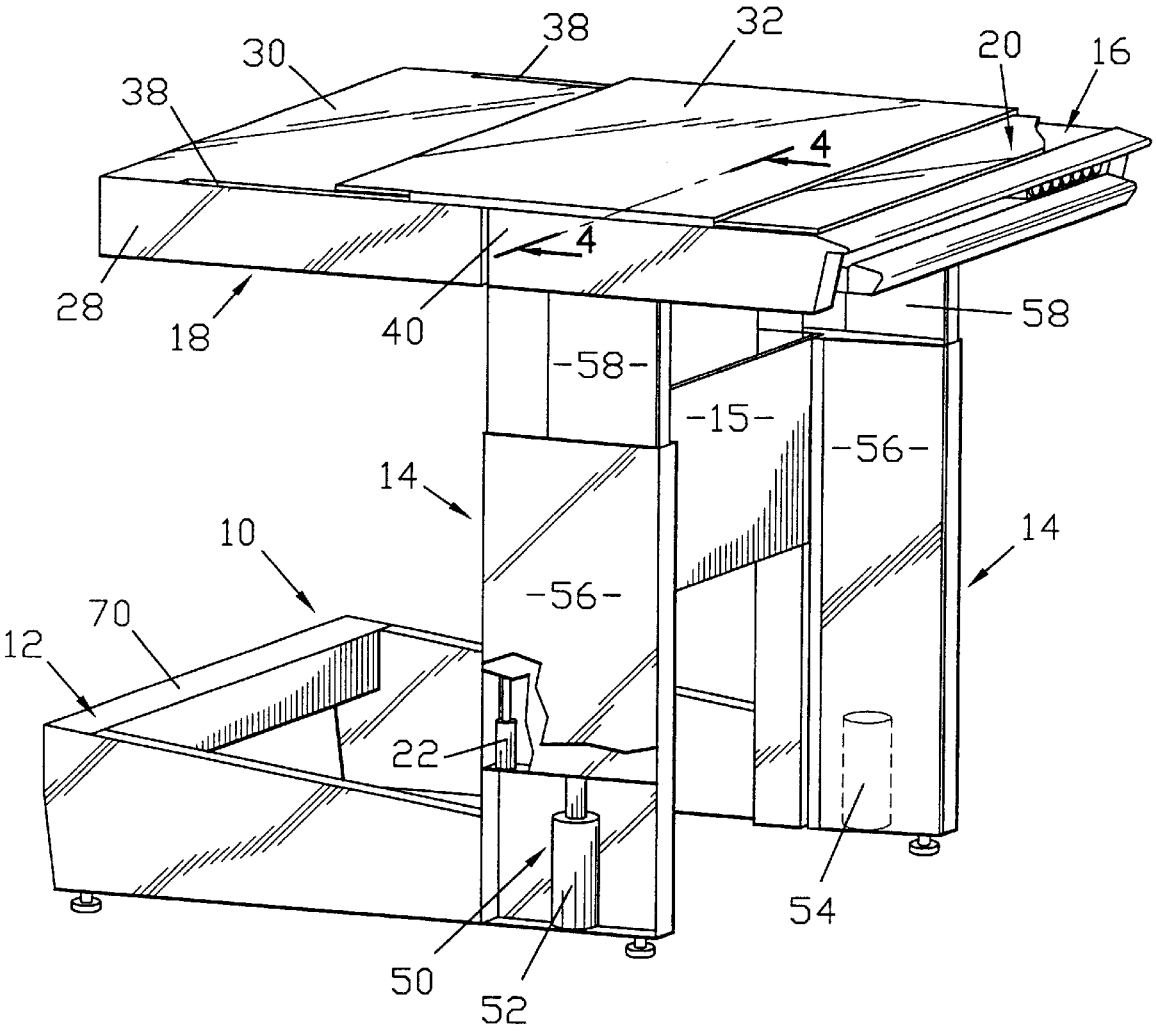
FIG. 1 is a perspective view of the front of a table conforming to the invention.

FIG. 1 shows a frame 10 with a base 12 and two stanchions 14 integral with said base and braced at 15.

The stanchions support a fixed plate 16 at the upper portion and a first mobile plate 18 on the rear in front of the rear of the fixed plate 16.

The fixed plate is also surmounted by a mobile plate 20 known hereafter as the second mobile plate.

This second plate is able to move horizontally parallel to the fixed plate.

Figure 2:
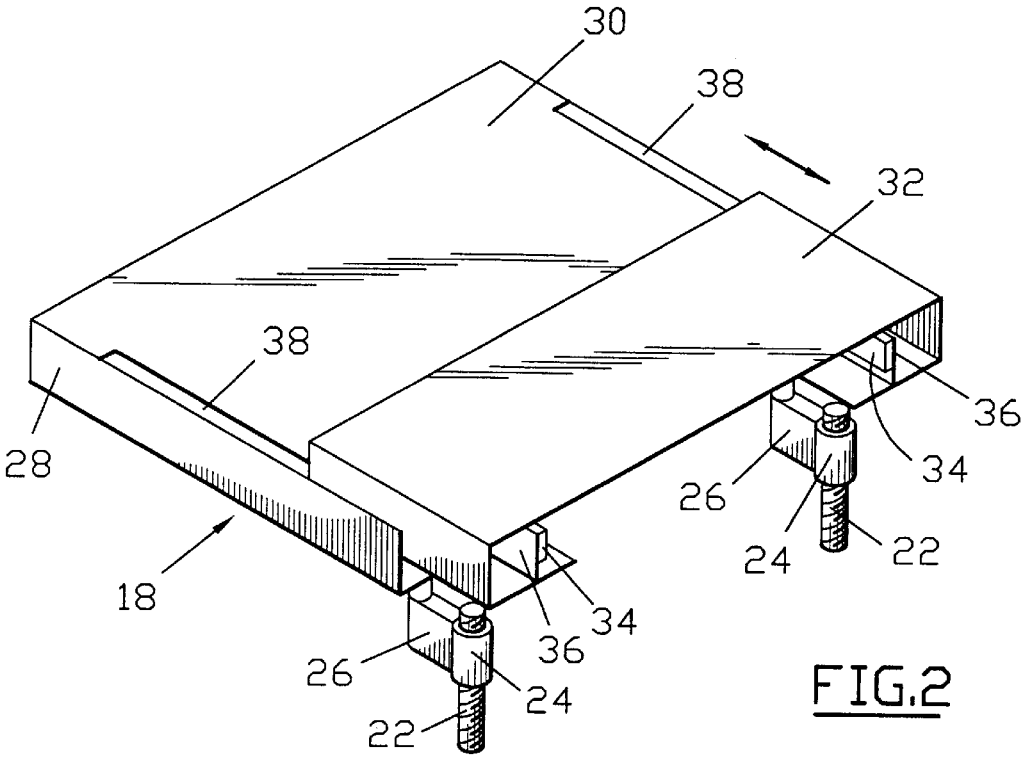
FIG. 2 is a detailed perspective view of the first plate with its auxiliary plate.

The first mobile plate 18 shown in detail on FIG. 2 is mounted on vertical screws 22 integrated in the stanchions by means of nuts 24 integral with arms 26 which support this first plate.

The first plate comprises two lateral U-shaped sections 28, the space between the two sections being hidden by a plate 30.

This first plate further includes an auxiliary plate 32 able to move horizontally.

This auxiliary plate 32 is mounted on the mobile portion with slides 34 secured to the wings 36 of the edge of this plate.

The fixed portions of the slides 34 are integral with the lower branch of the U-shaped lateral sections 28.

Two apertures 38 fitted in the plate 30 allow passage of the vertical edges of this auxiliary plate.

Figure 3:
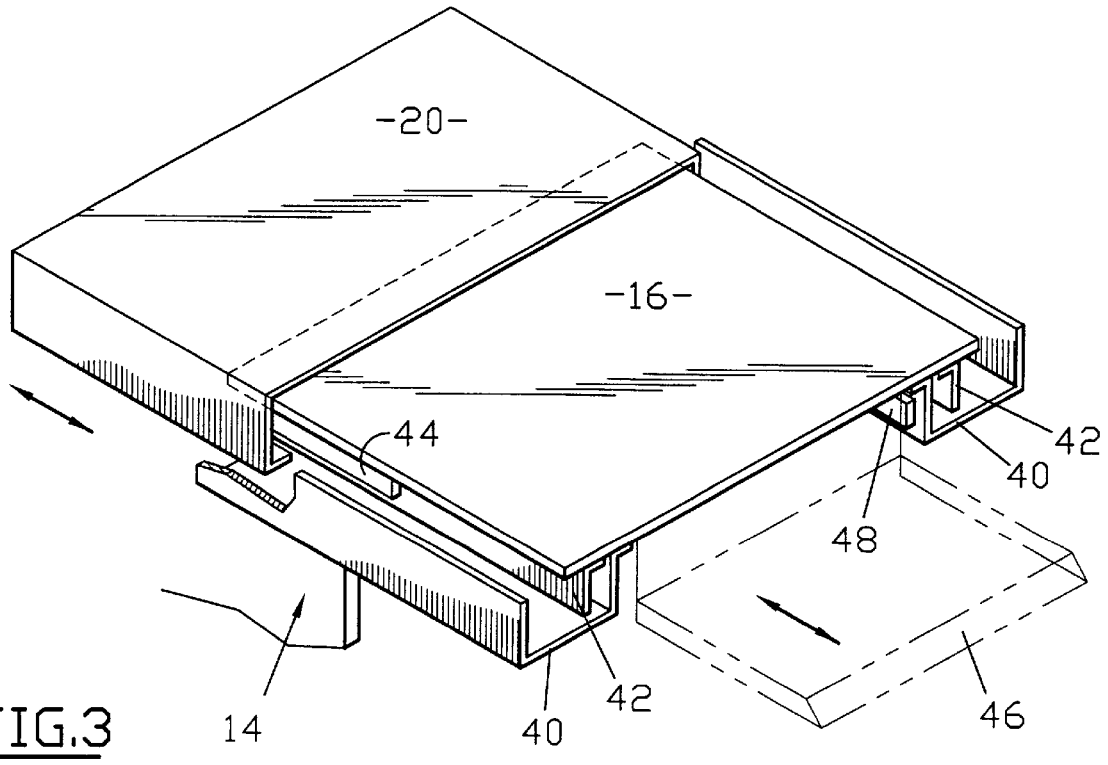
FIG. 3 is a detailed perspective view with partial pulling up of the fixed table with the second mobile plate.

As can be seen on FIG. 3, the fixed plate 16 includes two lateral U-shaped sections 40 and two vertical lateral wings 42 disposed under this plate.

The second plate 20 is able to move towards the rear by means of double slides 44, the fixed portions of these slides being integral with the vertical lateral wings 42.

The second mobile plate has edges with a C-shaped section which support the mobile portions of the slides 44 and which mask these slides.

Provided in front of the fixed plate 16 is a keyboard support plate 46, also able to move horizontally along the double arrow shown on FIG. 3.

This movement is carried out with the aid of slides 48 whose fixed portions are integral with the internal face of the internal branches of the lateral U-shaped sections 40.

Figure 4:
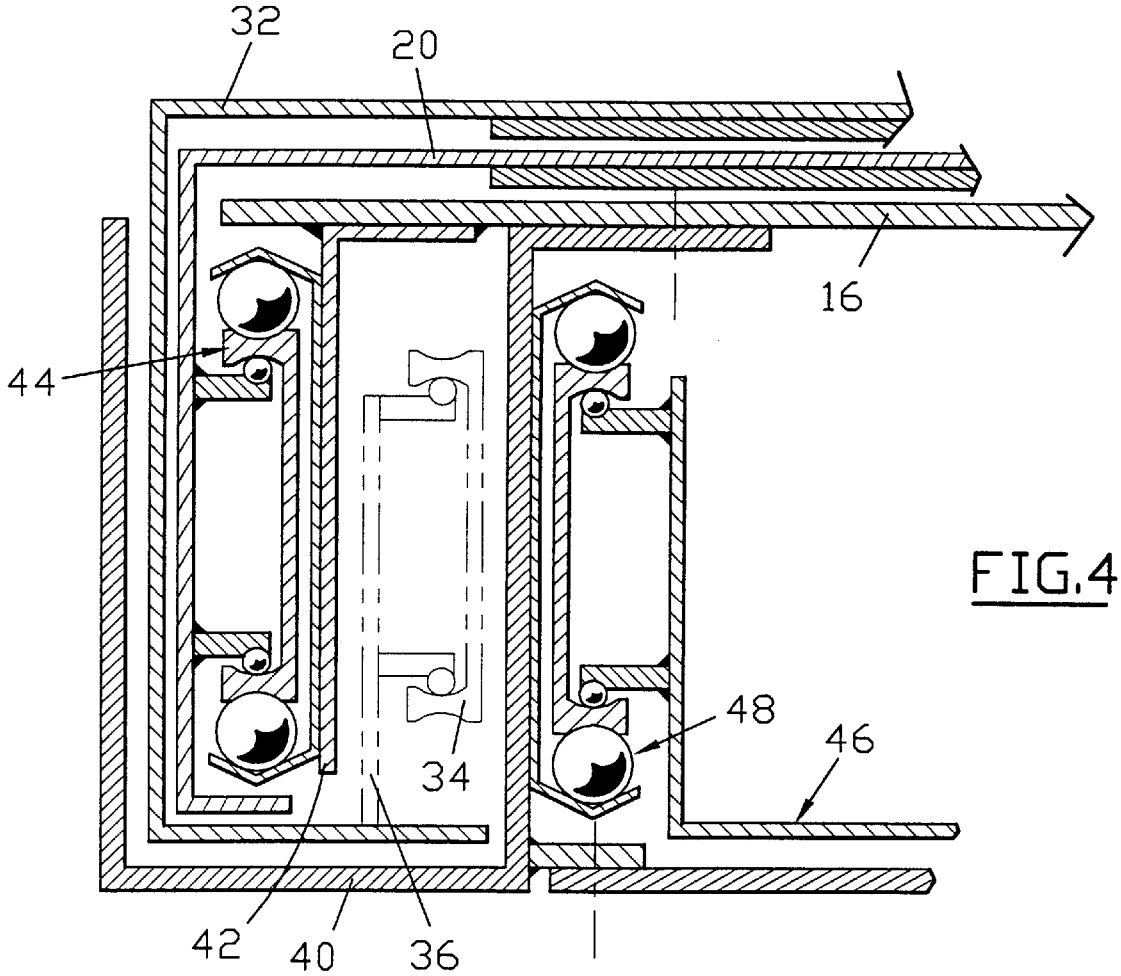
FIG. 4 is a cross section along the line 4—4 of FIG. 1.

The various plates and other elements to be described are shown on the section of FIG. 4 and bear the same references.

The two lateral U-shaped sections 28 and 40 are identical so as to embody guiding continuity when the first plate is in the upper position, as shown on FIGS. 1, 2, 3 and 4.

The stanchions 14 of the table of the invention include height adjustment means 50 with respect to the frame.

These adjustment means include a first and second jack 52 and 54 with screws, associated with each of the stanchions.

Each of the stanchions comprises two telescopic portions 56 and 58 between which the corresponding jack is inserted, the first portion 56 being integral with the base 12 of the frame 10 and the second portion 58 supporting the fixed 16 and mobile 18 plates.

The table of the invention is motorized for all the mobile elements, all the motors not being shown for the sake of simplification of the drawing and because they are well-known and are commercially available in large numbers.

Figure 5:
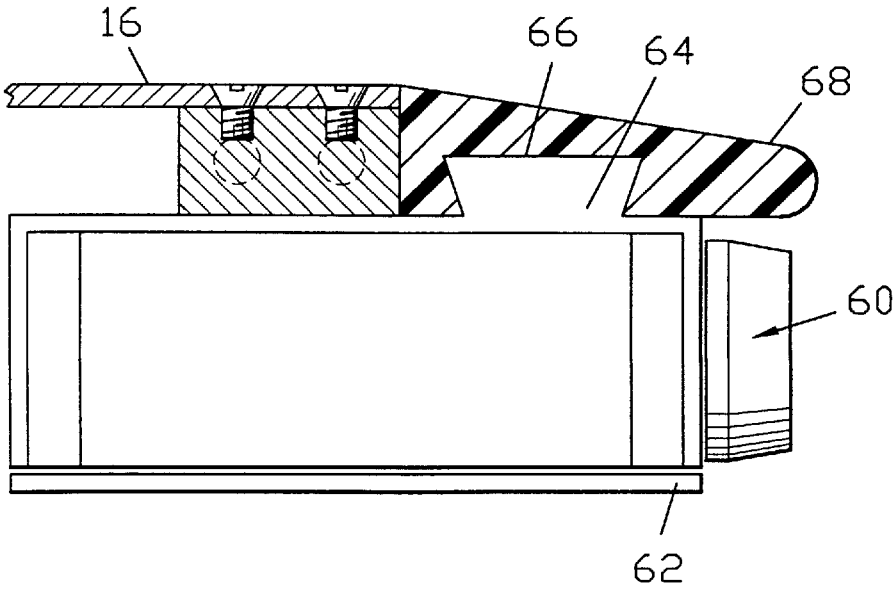
FIG. 5 is a sectional view of the wrist support and lateral translation mobile control box.

On the other hand and as shown on FIG. 5, an associated control box 60 is provided so as to trigger the various orders for movements of this box so as to move laterally with respect to the fixed plate.

To achieve this movement, this box is placed in a cradle 62 which includes a snug 64 with a round-tailed section mounted in a groove 66 fitted in a hand support 68 integral with the fixed plate and which extends it.

The implementation of the table described above is shown in detail so as to demonstrate its multi-purpose capacities.

The example represented shows a computer unit but this table is not solely dedicated to data processing, this item of equipment merely illustrating how to make use of a large number of possibilities.

Figure 6A:
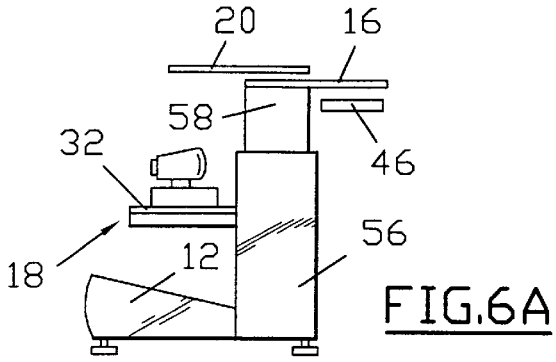
FIGS. 6A to 6H show a set of possible configurations able to be assumed by the table of the invention.

On FIG. 6A, the telescopic portions 58 are in the upper position, the mobile plate 18 is in the lower position and supports the computer hardware on its mobile auxiliary plate 32.

The second plate 20 is partially offset at the rear, the keyboard support plate 46 being at the re-entering position under the fixed plate 16.

This disposition is intended for school study or for manual work operations when the pupil needs space to work.

Figure 6B:
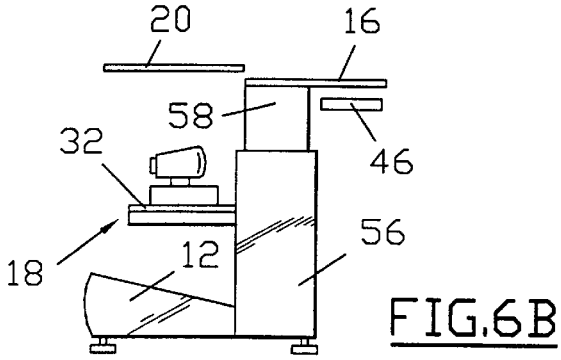

FIG. 6B corresponds to the maximum working zone surface similar to that of FIG. 6A, but in this case the second mobile plate 20 is offset at the maximum at the rear.

Figure 6C:
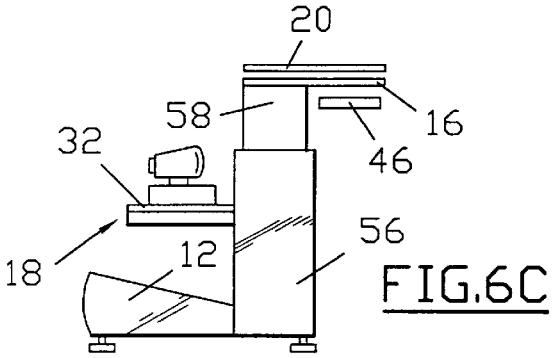

FIG. 6C is similar to FIG. 6A since only the second plate 20 is brought back to be superimposed with the fixed plate 16.

This corresponds to the most compact position of the table on a horizontal surface.

Figure 6D:
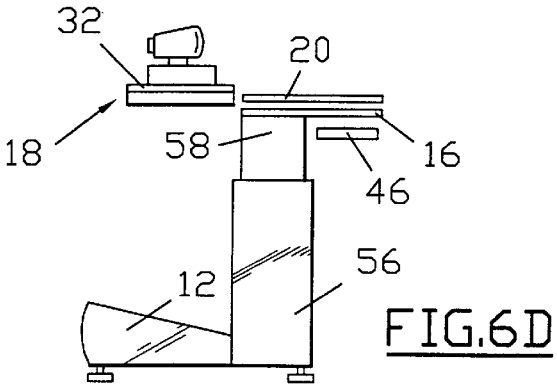

FIG. 6D shows a vertical movement of the first plate 18 until it arrives in front of the fixed plate 16.

Figure 6E:
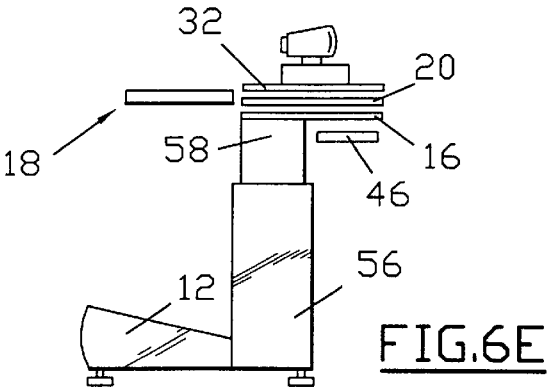

On FIG. 6E, the plate 32 is moved horizontally until it arrives on superimposition of the fixed plate and the second mobile plate, which is superimposed on said plate 16.

The computer hardware is located close to the user which enables him to make use of the unit or introduce a disk into the reader of the central unit, even if his arm reach is reduced.

Furthermore, the height is reduced via the descent of the mobile portions of the stanchions so as to ergonomically adapt the working station for the user when introducing a disk, for example.

Figure 6F:
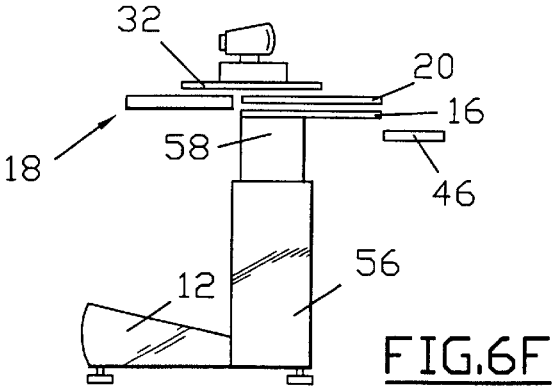

On FIG. 6F, the keyboard support plate 46 has come out so that the user can work.

In addition, the auxiliary plate 32 is partially pushed back so as to adapt the backward movement of the screen to enable this user to see properly.

The height is also adjusted for vision and access to the keyboard.

Figure 6G:
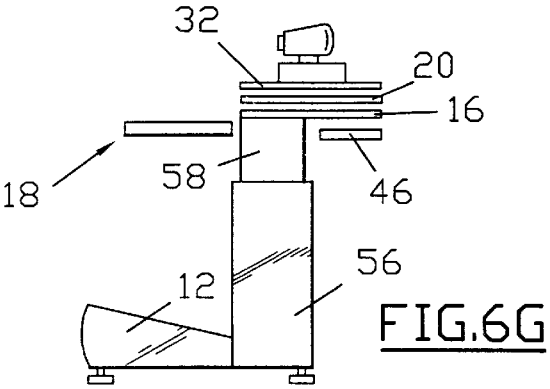

On FIG. 6G, the working height is again lowered and the fixed and mobile plates simultaneously follow the vertical movements since they are integral with the mobile portions of the stanchions.

This position is similar to that of FIG. 6E.

Figure 6H:
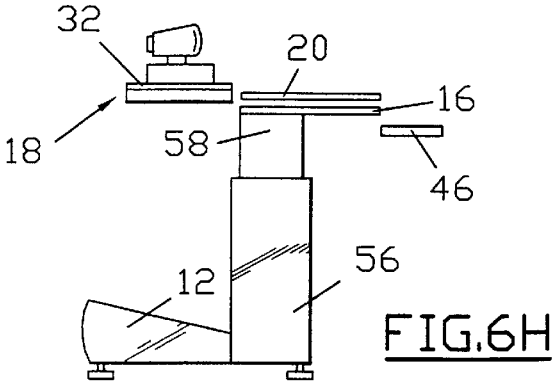

On FIG. 6H, the computer unit is pushed back via the return of the auxiliary plate 32 on superimposition with the first plate 18.

The keyboard support plate is still out, but this does, not prevent the user from lowering this first plate if he so desires.

During all these phases, the control box 60 can be moved laterally according to the capacities of the user.

Cable routes are provided so as to avoid any deterioration during the various movements of the plates.

Additionally, the table includes a clearance on the front face for access of wheelchairs for handicapped persons.

In addition, the frame includes a rear stop for protecting the space corresponding to the maximum rear spatial requirement of the plates.

The stop 70 is also a brace for the feet of the frame.

The frame is preferably mounted on adjustable feet.

Safety is ensured by force and end of travel sensors which stop any movement as soon as there is a resistant force and when the movement is maximum.

The table of the invention further includes a programmable robot which manages the movements of the mobile elements according to pre-established requirements.

This robot can allow intermediate movements required for certain applications.

Figure 7:
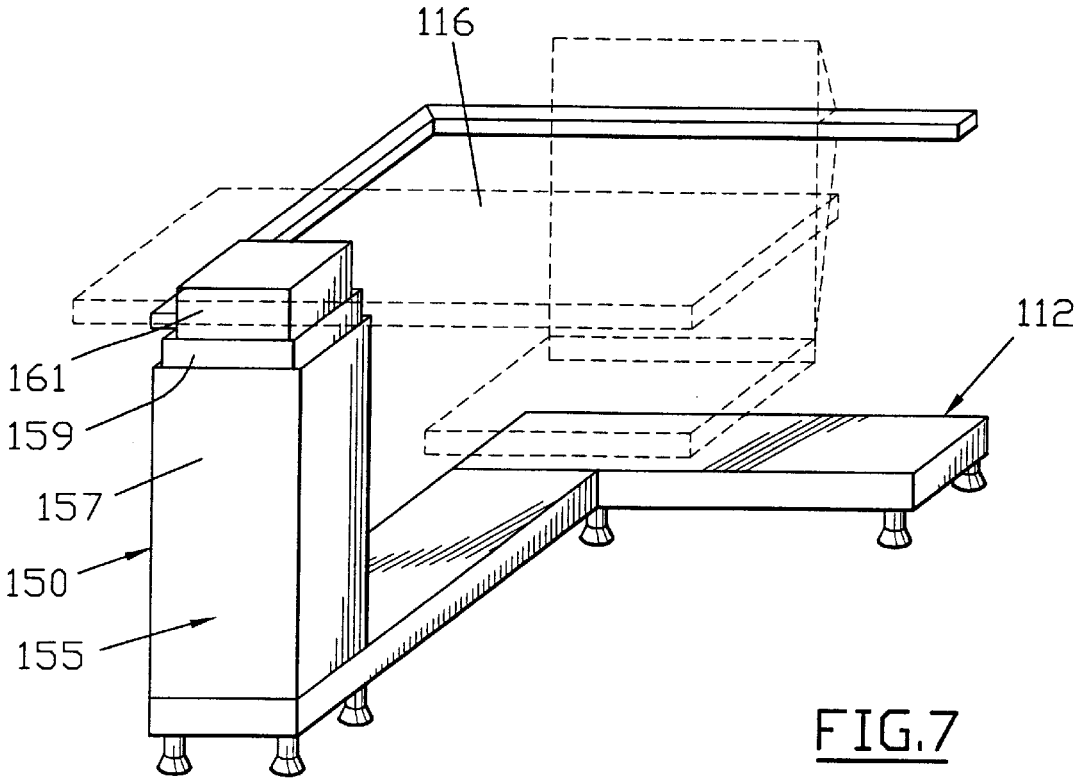
FIG. 7 is a perspective view of a variant for embodying the mode retained as the main embodiment.

FIG. 7 shows an industrialized variant in that the cabling and the frame are simplified and make use of more standardized commercial elements, especially for the control means.

Figure 9:
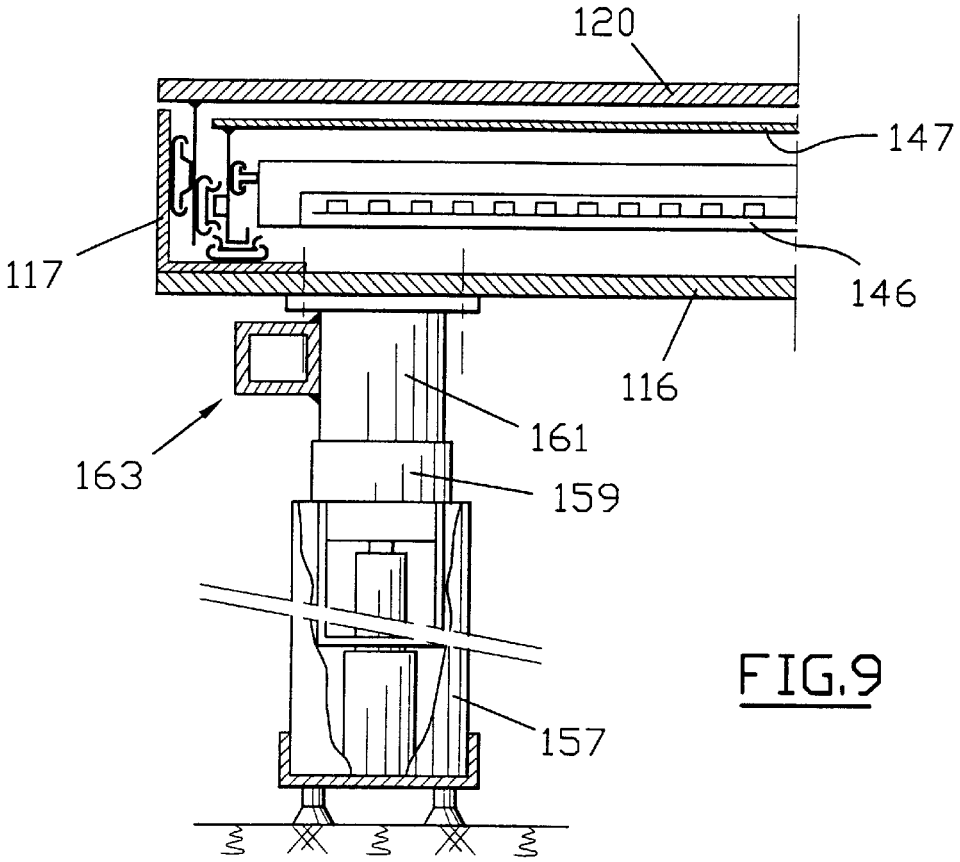
FIG. 9 is a partial cutaway half-view of the disposition of the lateral slides with a partial pull up view of the elements of the telescopic jack.
Figure 8:
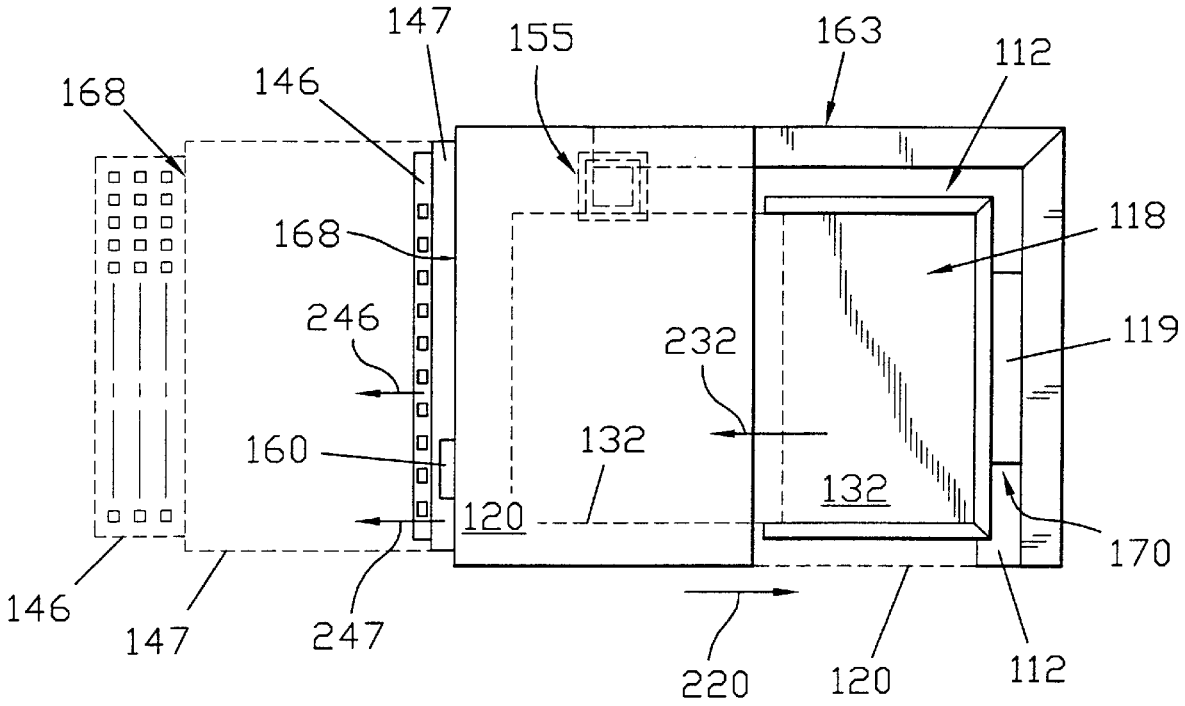
FIG. 8 is a diagrammatic top view showing the various plates with their travel.

The reference concerning the elements having the same functions as in the main embodiment are shown and increased by 100 on FIGS. 7, 8 and 9.

The frame 110 is modified in that it includes an L-shaped base 112 with the extremity of the L-shaped base supporting the height adjustment means 150 with a single telescopic jack 155 with three elements, the bottom element 157 being secured to the base 112, the intermediate element 159 being provided to reach the desired maximum working height and the upper element 161 supporting a fixed plate 116 equipped with two corners 117 (FIG. 9) between which various mobile plates are mounted:

a main plate 120 able to move along the arrow 220 and shown by the discontinuous line in its displaced position on FIG. 8, an intermediate plate 147 able to move along the arrow 247 with respect to the main plate towards the front of the latter and shown by the discontinuous line in its displaced position on FIG. 8, the main plate being on the front and a keyboard support plate 146 able to move along the arrow 246 with respect to the intermediate plate towards the front of the latter and shown by the discontinuous line in its displaced position on FIG. 8, the main and intermediate plates being on the front.

A support L-shaped girder 163 parallel to the base and able to be superimposed is rendered integral with the upper element 161 of the telescopic jack 155 via its first branch.

The second branch supports a plate 118 able to move vertically between a bottom retracted position and an upper working position approximately in the front of the main and intermediate plates. More specifically, this plate 118 able to move vertically is equipped with a portion forming an auxiliary plate 132 able to move horizontally along the arrow 232 so as to come above the main plate 120.

The means 119 for controlling the plate able to move vertically are integral with the second branch of the support girder 163. A screw/nut unit is preferably used.

The base also forms a rear stop 170.

It shall be observed that the front of the table remains free to allow access to wheelchairs for handicapped persons according to an extremely wide range corresponding to seated but also half-lying down positions.

As for safety elements, these are identical to those developed for the first embodiment and can be easily embodied by the man skilled in the art.

So as to control the programmable robot, also present to manage the various movements and safety devices, a box, wire remote control or wire-free remote control device can be used.

In the embodiment represented on FIG. 8, a mobile box 160 is shown diagrammatically and mounted on the intermediate plate 147.

I claim:

1. An ergonomically adjustable table with movable elements, for use by a handicapped person, the table having a front end, a rear end, and comprising:

a frame with a base;

at least one stanchion coupled to said base;

a fixed plate supported by said stanchion;

said table having at said rear end a first mobile plate structured and arranged to move vertically between a bottom retracted position and an upper working position relative to the fixed plate, and at least an auxiliary plate disposed immediately above and parallel to the first mobile plate, said auxiliary plate structured and arranged to move horizontally;

a second mobile plate disposed immediately above and parallel to said fixed plate, said second mobile plate being movably coupled to said fixed plate, and being structured and arranged to move horizontally with respect to the fixed plate toward the rear end.

2. The table according to claim 1, further comprising a support plate disposed immediately below and movably coupled to the fixed plate, said support plate structured and arranged to move horizontally with respect to the fixed plate so as to be offset towards the front end, said support plate adapted to support a keyboard.

3. The table according to claim 1, comprising two said stanchions.

4. The table according to claim 3, wherein each stanchion includes height adjustment means for adjusting the height of the frame.

5. The table according to claim 4, wherein the height adjustment means include a first and a second jack, each associated with each of the stanchions, each of the stanchions including a first telescopic portion and a second telescopic portion for accommodating a corresponding jack therebetween, the first telescopic portion being integral with the base of the frame, and the second telescopic portion supporting the fixed and first mobile plates.

6. The table according to claim 4, wherein the height adjustment means include a single telescopic jack with at least a bottom element and an upper element, the bottom element being integral with the base of the frame, and the upper element supporting the fixed and mobile plates.

7. The table according to claim 1, wherein a frontal edge of the fixed plate includes means for moving a control box laterally.

8. The table according to claim 1, wherein the frame includes a clearance to provide access to wheelchairs of handicapped persons.

9. The table according to claim 1, wherein the frame includes a rear stop.

* * * * *